United States Patent [19]

Bione

[11] 4,404,883

[45] Sep. 20, 1983

[54] INTEGRATED HARMONY GENERATING CIRCUIT FOR ELECTRONIC ORGAN

[75] Inventor: Angelo A. Bione, Elmhurst, Ill.

[73] Assignee: The Marmon Group, Inc., Chicago, Ill.

[21] Appl. No.: 226,117

[22] Filed: Jan. 19, 1981

[51] Int. Cl.[3] ..... G10H 1/00

[52] U.S. Cl. ..... 84/1.03; 84/1.17; 84/1.01

[58] Field of Search ..... 84/1.01, 1.03, 1.17, 84/1.24, DIG. 22

[56] References Cited

U.S. PATENT DOCUMENTS

| | | | |
|---|---|---|---|
| Re. 29,144 | 3/1977 | Bunger | 84/1.01 |
| 3,629,480 | 12/1971 | Harris | 84/1.03 |
| 3,839,592 | 10/1974 | Freeman | 84/1.01 |
| 3,889,568 | 6/1975 | Amaya | 84/1.01 |
| 4,072,078 | 2/1978 | Shallenberger et al. | 84/1.03 |
| 4,256,002 | 3/1981 | Schwartz et al. | 84/1.01 |
| 4,300,433 | 11/1981 | Schreier et al. | 84/1.17 |
| 4,319,508 | 3/1982 | Schwartz et al. | 84/1.01 |

*Primary Examiner*—F. W. Isen

*Attorney, Agent, or Firm*—Neuman, Williams, Anderson & Olson

[57] ABSTRACT

A harmony signal generating system for an electronic organ comprises a plurality of integrated circuit chips which each receive upper and lower manual keying signals for two consecutive organ notes. A first read only memory (ROM) generates octave identify signals to designate the octave of an active upper manual note. A second ROM generates octave select signals which are combined with the octave identify signals in a third ROM to generate the harmony signals which comprise the lower manual chording signals played through the upper manual within a twelve note range above an active upper manual note and an upper manual note which is one octave above the active upper manual note. The octave identify signals are provided in parallel among the chips from the chip having the lowest active upper manual letter note. Upper manual active signals generated in response to the upper manual keying signals are connected in series among the chips to select the appropriate chip. Internally generated octave identify signals are used on each chip which receives an active upper manual keying signal to accurately generate upper manual notes one octave above active upper manual notes when more than one upper manual key is depressed.

5 Claims, 4 Drawing Figures

HARMONY-ON
KD

INTEGRATED HARMONY GENERATING CIRCUIT FOR ELECTRONIC ORGAN

BACKGROUND OF THE INVENTION

This invention relates generally to electronic organs and more particularly to an electronic organ including integrated circuitry for generating harmony signals within an octave (within a twelve note range) above a melody note being played on the upper manual of the electronic organ. The harmony signals are played through the upper manual within the octave above the melody note being played on the upper manual and include notes corresponding to chording notes being played on the lower manual and the melody note.

It has always been desirable from a musical standpoint for an organist to include harmony notes which are both below the melody being played upon the upper manual and related to the chords being played upon the lower manual. Although playing such harmony signals requires great manual dexterity and concentration, many professional organists frequently use the technique to enhance and complement the music being played. An amateur organist is rarely able to master such a complicated playing technique but, nevertheless, would like to enhance the music being played to the same degree as the professional organist.

Various automatic harmony systems have been developed for providing the beginning organist with the capability of playing harmony notes below the melody being played. However, these available automatic harmony systems are often times complex and cumbersome arrangements of mechanical switching devices for generating the harmony signals in response to the depression of keys on both the lower manual or accompaniment manual and the upper manual or melody manual. Electronic circuitry including digital circuitry has been devised to replace the mechanical switching devices and to generate harmony signals in electronic organs. These automatic harmony systems enable the organist to perform what otherwise is a complex maneuver of incorporating harmony signals on the upper manual in the octave below the melody note being played and to co-ordinate these harmony signals with the notes being played on the lower manual.

The harmony signals provided by the above automatic harmony systems are in the octave below the melody note and tend to "muddy" or degrade the sounds generated by an electronic organ since lower pitch harmony signals are being added and the harmonics from the individual notes being sounded on the upper manual tend to clash as the notes get lower in pitch. Accordingly, Application Ser. No. 163,714 filed June 27, 1980, which is assigned to the same assignee as the present application, provides harmony signals in response to lower manual chording signals and an upper manual melody note with the harmony signals corresponding to the chording signals but being generated through the upper manual approximately one octave above the upper manual melody note. These high harmony signals delay the organ tone from becoming "muddy" until lower pitch melody notes are played since higher pitch harmony signals are being added. The use of such high harmony signals extends the effective range of melody notes being played on the upper manual to include lower pitch notes.

SUMMARY OF THE INVENTION

In the present invention, the harmony system generates harmony signals within a twelve note range above the melody note being played on the upper manual. The harmony signals include signals corresponding to the lower manual chording notes and supplementally include a signal corresponding to the upper manual melody note but being one octave higher in pitch. The harmony signal generating system is responsive to lower manual chording signals and an upper manual melody note and in a preferred embodiment, is constructed as an integrated circuit. These supplemented high harmony signals present an improved, pleasing musical effect and also prevent the organ tone from becoming "muddy" until lower pitch melody notes are played since the harmony signals being added are higher in pitch than the melody notes.

The harmony generating system of the present invention is included in an electronic organ having a lower manual for generating lower manual keying signals and an upper manual for generating upper manual keying signals. The harmony generating system comprises a plurality of integrated circuit chips with each chip receiving upper manual keying signals and lower manual keying signals for at least one note of the electronic organ. Each integrated circuit chip includes octave identify means which is responsive to the upper manual keying signals for generating octave identify signals that identify the octave of an upper manual note corresponding to a depressed key on the upper manual, hereinafter referred to as an active upper manual note. For purposes of discussion, the upper manual of a forty-eight note keyboard organ can be divided into four octaves, each octave containing twelve chromatic notes beginning with the letter notes C. Each integrated circuit chip also includes first circuit means which is responsive to the upper manual keying signals for generating upper manual active signals; octave select means which is responsive to the lower manual keying signals and the upper manual active signals for generating octave select signals; and second circuit means which is responsive to the octave identify signals and the octave select signals for generating the harmony signals in the proper octaves.

Each of the integrated circuit chips also includes octave identify terminals which are connected in parallel among the plurality of chips and upper manual active terminals which are connected in series among the plurality of chips. An upper manual active signal on any of the chips is passed to succeeding chips via the series connection of the upper manual active terminals. Chips preceding a chip with an active upper manual input do not receive the upper manual active signal.

The integrated circuit chips are arranged in a priority chain so that the octave identify signals from the first chip in the chain having an active upper manual note are gated to all the chips in response to the upper manual active signal. Thus, the octave identify signals which identify the octave of the lowest active upper manual letter note is gated to the parallel connected octave identify terminals of all the integrated circuit chips. Each integrated circuit chip preceding a chip with an active upper manual note generates harmony note signals in the octave above the identified octave while those succeeding the chip generate the harmony note signals in the same octave as that identified. The series connection of the upper manual active terminals of each chip forms the priority chain and allows the first chip which has an active upper manual note in the chain to control the octave identify signals.

The harmony signals are played through the upper manual in the octave above an active upper manual note and/or in the same octave as an active upper manual note but above the active upper manual note itself. We define two letter notes as being within the same octave if both letter notes are within the same twelve note sequence beginning with a C note and ending with a B note. Thus, the harmony signals are played through the upper manual within a twelve note range above the active upper manual note. For example, if an E note is played on the upper manual, the corresponding harmony notes which could be played through the upper manual include two groups. The first group of letter notes are F, F♯, G, G♯, A, A♯ and B which are within the same octave as the active upper manual note, the E note, but are above the E note itself. The second group of letter notes are C, C♯, D, D♯ and E which are in the octave above the octave of the active upper manual note. The harmony signals then include an upper manual note corresponding to the active upper manual note and being played one octave above the active upper manual note; and upper manual notes corresponding to the chording notes being played on the lower manual and being played through the upper manual within a twelve note range above an active upper manual note.

An internal override circuit is provided on each integrated circuit chip so that if more than one key on the upper manual is simultaneously depressed, each chip which receives an upper manual keying signal corresponding to an active upper manual note will use its own internally generated octave identify signals for generating its harmony signals as opposed to the octave identify signals received through the parallel connection among the chips. The octave identify signals of the lowest letter note in the chromatic sequence from C to B controls all integrated circuit chips except those chips receiving an upper manual keying signal from an active upper manual note. An upper manual active signal is generated on each chip which receives an upper manual keying signal from an active upper manual note and that upper manual active signal controls gating circuitry to switch between the octave identify terminals and the internal octave identify signals. The internal override circuit provides accurate generation of the upper manual notes one octave above active upper manual notes when more than one upper manual key is depressed.

BRIEF DESCRIPTION OF THE DRAWING

For a more complete understanding of this invention, reference should now be made to the embodiment illustrated in greater detail in the accompanying drawing and described below by way of example of the invention. In the drawing.

DETAILED DESCRIPTION OF THE ILLUSTRATIVE EMBODIMENT

Figure 1:
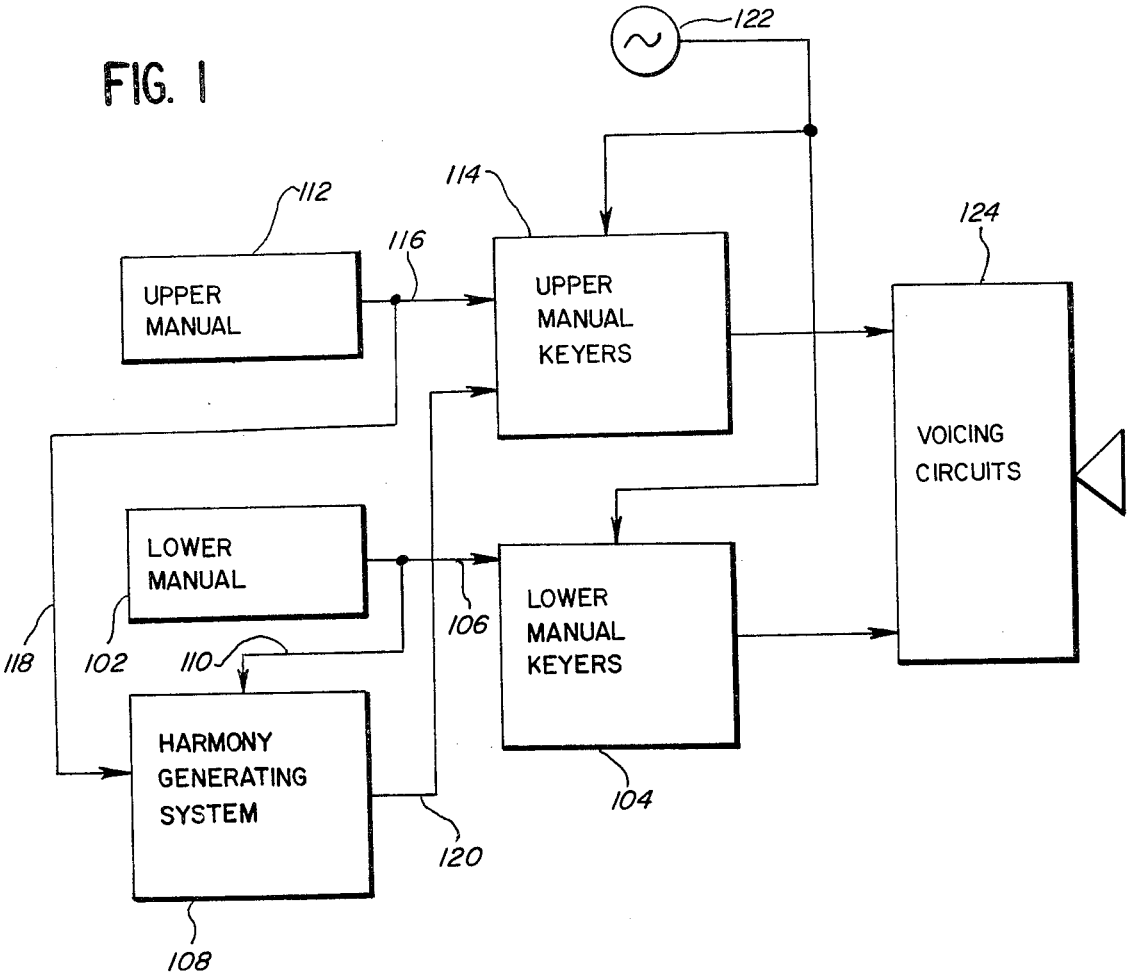
FIG. 1 is a block diagram of an organ incorporating the harmony generating system in accordance with the present invention.

FIG. 1 is a block diagram of an electronic organ which includes the harmony signal generating system of the present invention. An organist normally plays accompaniment notes or chords with the left hand on a lower manual 102. The lower or accompaniment manual 102 includes a plurality of keys, each of which generates a lower manual keying signal when depressed by the organist. The depression of more than one key on the accompaniment manual generates a corresponding number of keying signals. The lower manual keying signals are passed to lower manual keyers 104 on the conductors 106. Lower manual keying signals are also passed to the harmony signal generating system 108 via the conductors 110.

The organist normally plays melody notes with the right hand on an upper or melody manual 112. The upper manual 112 comprises a plurality of keys which span several octaves of frequency. For example, a forty-eight note keyboard will have four octaves each consisting of twelve chromatic notes beginning with the letter note C. The depression of each of these keys by the organist generates upper manual keying signals in the same manner as the accompaniment manual 102. The upper manual keying signals are passed to upper manual keyers 114 on the conductors 116. Upper manual keying signals are also passed to the harmony generating system 108 via the conductors 118.

The harmony generating system 108 in accordance with the present invention, generates upper manual harmony signals in response to both the lower manual keying signals and the upper manual keying signals. The upper manual harmony signals from the harmony generating system 108 are passed to the upper manual keyers 114 via the conductors 120.

The lower manual keyers 104 and the upper manual keyers 114 receive tone signals of various frequencies from the top octave generator and divider circuit 122. The lower manual keyers 104 pass tone signals selected by the lower manual keying signals to the voicing circuits 124 which generate audible music tones. Similarly, the upper manual keyers 114 pass tone signals selected by the upper manual keying signals and the harmony signals to the voicing circuits 124.

Figure 2:
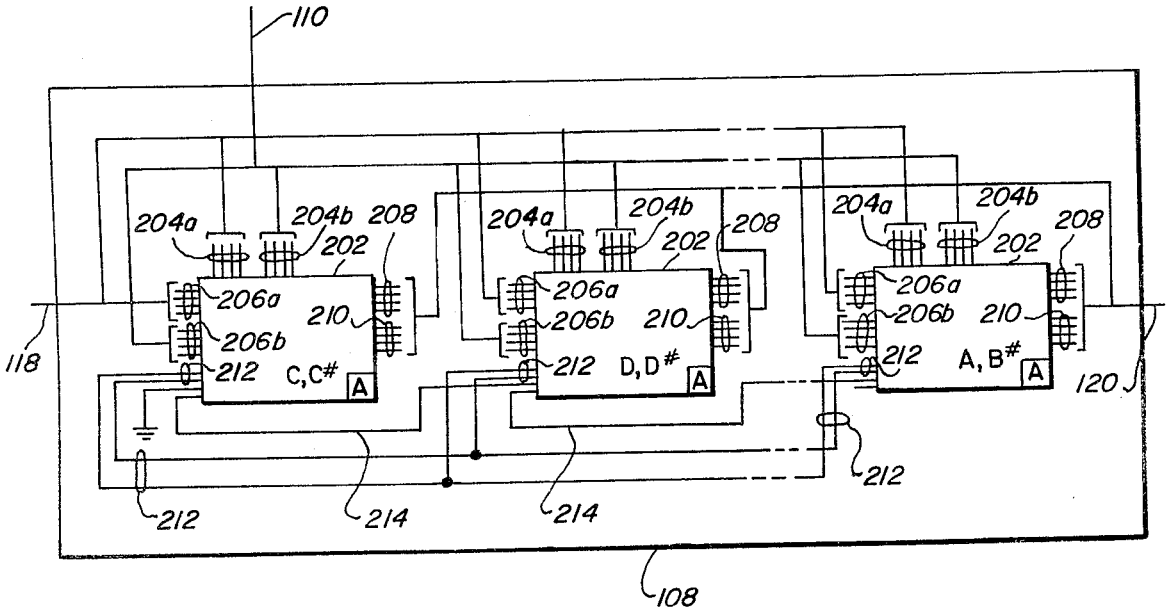
FIG. 2 is a block diagram showing the interconnection of a plurality of individual integrated circuit chips to form the harmony generating system of the present invention.

FIG. 2 is a block diagram of one illustrative embodiment of the harmony signal generating system 108 of the present invention. In this illustrative embodiment, a plurality of integrated circuit chips 202 are interconnected to form the harmony generating system 108. Each integrated circuit chip 202 generates the harmony signals for two letter notes of the electronic organ. Accordingly, the harmony generating system contains six integrated circuit chips. However, it is within the scope of the present invention to increase or decrease the number of letter notes serviced by each integrated circuit chip.

Figures 3, 4:
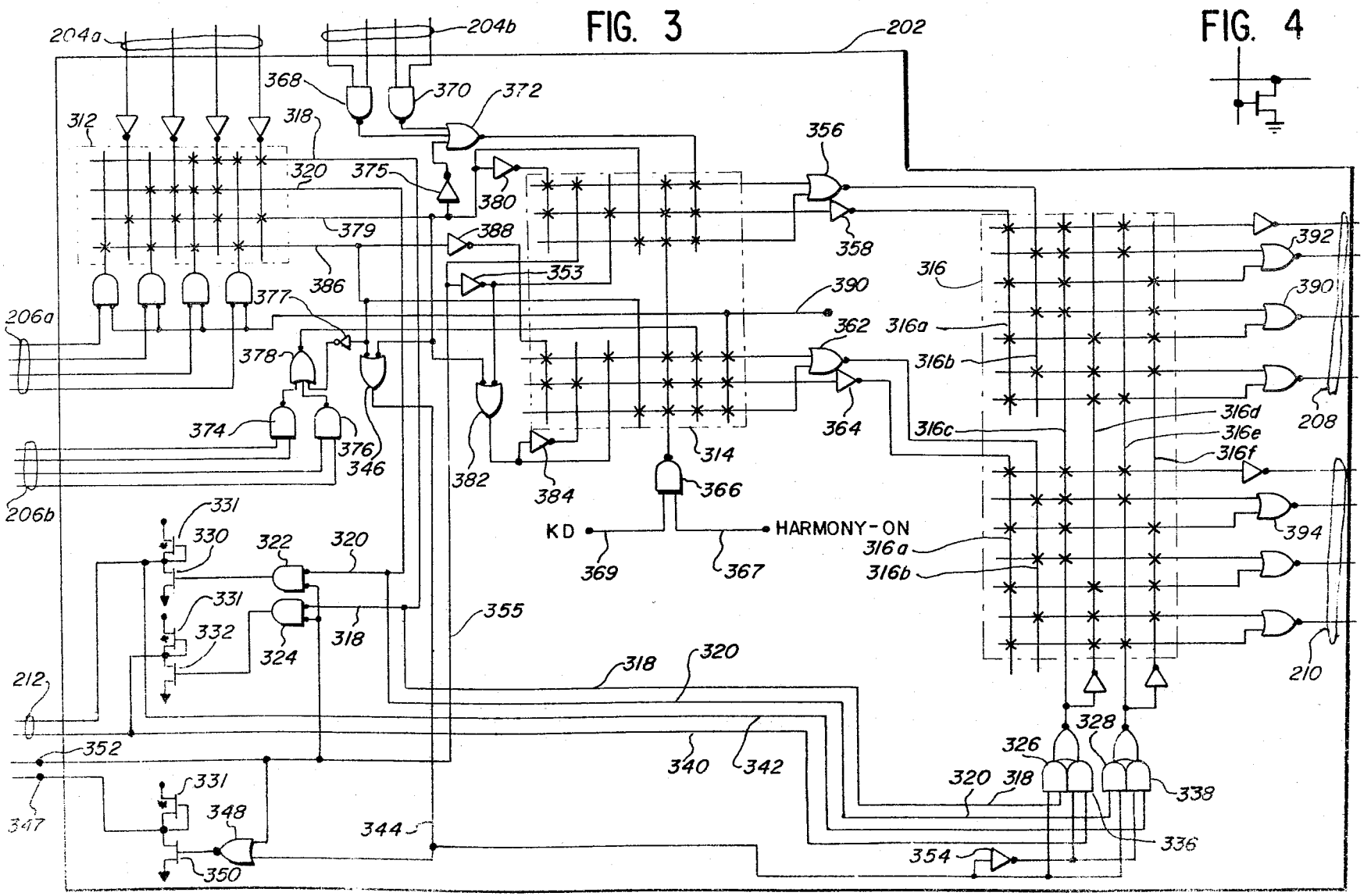
FIG. 3 is a schematic diagram of one of the individual integrated circuit chips of the harmony generating system of FIG. 2.
FIG. 4 is a schematic diagram of one of the individual crosspoints of the read only memories shown in FIG. 3.

FIG. 3 is a schematic diagram of one of the integrated circuit chips 202 which are interconnected in FIG. 2 to form the harmony generating system 108. The upper manual keying signals for a specific letter note in each octave of the upper manual are received on the conductors 204*a* while the lower manual keying signals for the same letter note in each octave of the lower manual are received on the conductors 204*b*. The upper manual keying signals for the next letter note in the chromatic sequence are received on the conductors 206*a* while the corresponding lower manual keying signals are received on the conductors 206*b*. The musical chromatic scale comprises repetitive sequences or octaves of the following notes: C, C#, D, D#, E, F, F#, G, G#, A, A# and B. Thus, if the upper manual keying signals and lower manual keying signals for the D note are received on the conductors 204*a* and 204*b* respectively, the upper manual keying signals and the lower manual keying signals for the D# note are received on the conductors 206*a* and 206*b* respectively. This ordering of the input signals to the integrated circuit chips 202 is important to the operation of the harmony generating system 108 as will become apparent.

Harmony keying signals for the first letter note of each circuit chip or the note corresponding to keying signals received on the conductors 204*a* and 204*b* are generated on the output conductors 208. Harmony keying signals for the second letter note of each circuit chip or the note corresponding to keying signals received on the conductors 206*a* and 206*b* are generated on the output conductors 210.

The circuit elements 312, 314 and 316 in FIG. 3 which appear as generally cross-hatched areas with x's on various intersections of the cross-hatchings, are metal oxide silicon (MOS) read only memories (ROM's). The vertical lines of the ROM's are input conductors and the horizontal lines are output conductors. The x's at the intersections of various cross-hatched lines represent MOS field effect transistors (FET's) which connect the horizontal line to ground if a negative potential is present on the vertical line going through the x, see FIG. 4. The horizontal lines are connected to a source of potential through individual pull up resistors (not shown) to maintain a defined potential on the outputs of the ROM's if none of the corresponding FET's are active. A "logical" representation of the ROM's is a NOR gate for each horizontal line. The inputs to the NOR gates are the vertical lines having an x at their intersection with the horizontal line. With ground potential representing a logical "0" and a negative voltage representing a logical "1", the NOR gate analogy becomes clear.

Both the upper and lower manual keying signals are active for a high voltage signal or logical 0 and inactive for a low voltage signal or logical 1. If an upper manual keying signal becomes active indicating that a corresponding upper manual key has been depressed, the octave of that upper manual note is identified by the signals generated on the conductors 318 and 320 (octave identify signals) by octave identifiy means including the read only memory 312. The octave identify signals are passed to the bus gates 322 and 324 and to the AND gates 326 and 328. The bus gates 322 and 324 drive inverting transistors 330 and 332 which buffer the outputs of the bus gates 322 and 324 and drive the octave identify bus which comprises the two conductors 212. As shown in FIG. 2, the octave identify bus comprising the conductors 212 is connected in parallel among the integrated circuit chips 202. The conductors 212 of the octave identify bus are also connected to the AND gates 336 and 338 via the conductors 340 and 342 respectively.

If an upper manual keying signal becomes active due to the depression of an upper manual key, an upper manual active signal is generated on the conductor 344 by the gate 346 and the ROM 312. The upper manual active signal is passed to an upper manual active output terminal 347 via a NOR gate 348 and an inverting buffer transistor 350. The upper manual active output terminal 347 of each integrated circuit chip 202 is connected by the conductors 214 to the upper manual active input terminal 352 of the succeeding chip or the chip immediately to its right as shown in FIG. 2. The first chip 202 in the line or leftmost chip as shown in FIG. 2 has its upper manual active input terminal 352 connected to a logical 0 or high voltage level. The last chip 202 in the line or rightmost chip as shown in FIG. 2 has its upper manual active output terminal 347 unconnected. The transistors 331 serve as depletion pull up devices for the buffer transistors 330, 332 and 350.

The upper manual active signal which is passed serially among the chips via the terminals 352 and 347 and the conductors 214 selects the proper octave for the harmony signals, i.e., either the same octave as the active upper manual note or the octave above the active upper manual note. This octave selection is performed by the ROM 314 and its associated output circuitry which comprises the inverters 358 and 364 and the NOR gates 356 and 362. The upper manual active signal on the conductor 344 of each chip selects the internal octave identify signals of the chip on the conductors 318 and 320 if an upper manual keying signal is active on the chip. The selection of the internal octave identify signals on each chip with an active upper manual keying signal insures that active upper manual notes are repeated one octave higher in pitch. Otherwise, the octave identify signals from the first chip with an active upper manual note would dictate the octave for the harmony signal corresponding to all upper manual melody notes if more than one upper manual note is active. Accordingly, the internal octave identify selection overrides the octave identify signals on the octave identify bus 212 to accurately generate upper manual notes one octave above active upper manual notes when more than one upper manual key is depressed. The selection of the internally generated octave identify signals or the external octave identify signals on the bus 212 is performed by the upper manual active signal on the conductor 344. The upper manual active signal drives the inverter 354 and the AND gates 326, 336, 328 and 338 to select the internal octave identify signals.

The upper half of the ROM 314 together with the NOR gate 356 and the inverter 358 drive the upper half of the ROM 316 to respectively select either the octave above an active upper manual note or the same octave as an active upper manual note for the harmony keying signals of the first note of the integrated circuit package. The lower half of the ROM 314 together with the NOR gate 362 and the inverter 364 drive the lower half of the ROM 316 to respectively select either the octave above an active upper manual note or the same octave as an active upper manual note for the harmony keying signals of the second note of the integrated circuit package.

The harmony circuit 108 is activated by the NAND gate 366 when both a harmony-on signal 367 and a key down signal 369 are activated. The harmony-on signal 367 is controlled by a switch on the organ control panel and the key down signal 369 is generated whenever an upper manual key is depressed. If these two signals are not present, the ROM 314 is locked in an off state such that no harmony keying signals are generated on the conductors 208 and 210.

The upper half of the ROM 314 is similarly activated by the lower manual keying signals on the conductors 204*b*. If any of the lower manual keying signals are active on the conductors 204*b*, the upper half of the ROM 314 is unlocked via the NAND gates 368, 370 and the NOR gate 372. A similar locking arrangement is provided for the lower half of the ROM 314 via the NAND gates 374, 376 and the NOR gate 378. The upper and lower halves of the ROM 314 are also unlocked by active upper manual keying signals on the conductors 204*a* and 206*a* respectively. The upper half of the ROM 314 is unlocked by the NOR gate 372, the inverter 375 and the ROM 312 in response to an active upper manual keying signal on one of the conductors 204*a*. The lower half of the ROM 314 is unlocked by the NOR gate 378, the inverter 377 and the ROM 312 in response to an active upper manual keying signal on one of the conductors 206*a*.

If the input signal on the upper manual active input terminal 352 indicates that an upper manual keying signal is active on a chip to the left or earlier in the chain of integrated circuit chips, the read only memory 314 is forced to select notes in the same octave as an active upper manual note via conductor 355, the inverters 353, 384 and the gate 382. If an upper manual keying signal is active for the first note of the chip on one of the conductors 204*a*, then the upper half of the ROM 314 is forced to select the octave above the active upper manual note via the ROM 312, the conductor 379 and the inverter 380. Also such an active upper manual signal on one of the conductors 204*a* forces the lower half of the ROM 314 to select the same octave as the active upper manual note via the ROM 312, the gate 382 and the inverter 384. If an upper manual keying signal is active for the second note of the chip on one of the conductors 206*a*, the lower half of the ROM 314 is forced to select the octave above the active upper manual note via the ROM 312, the conductor 386 and the inverter 388.

The integrated circuit chip 202 includes conductor 390 for turning off the lower half of the chip for special applications or to provide a harmony generating circuit for a single note of an electronic organ.

The ROM 316 combines the octave identify signals and the ocatave select signals to generate the upper manual harmony signals on the conductors 208 and 210. The operation of the ROM 316 is best understood by viewing FIG. 3. The first two vertical columns 316*a* and 316*b* of the ROM 316 are activated by the ROM 314 and the NOR gates 356 and 362 and the inverters 358 and 364 as previously described to select the same octave as an active upper manual note or the octave above an active upper manual note. The third, fourth, fifth and sixth columns 316*c*, 316*d*, 316*e* and 316*f* of the ROM 316 are activated by the upper manual octave identify signals to enable the third column 316*c* or the fourth column 316*d* and the fifth column 316*e* or the sixth column 316*f* so that two octaves corresponding to an active upper manual note and the octave above the active upper manual note are enabled. The combination of these two selections by the ROM 316 generates the required harmony keying signals which are conducted to the upper manual keyers 114 via the conductors 208 and 210 which make up the conductors 120 of FIG. 1.

The operation of the harmony generating system in accordance with the present invention will now be described for a G note being played on the upper or harmony manual and a C major chord C, E, G being played on the lower or accompaniment manual. The key down signal 369 is active due to the G note being played on the upper manual and it is assumed that the harmony-on signal 367 is active. Accordingly, the harmony generating circuit 108 is turned on via the NAND gate 366. Assume that the chip shown in FIG. 3 corresponds to the leftmost chip of FIG. 2 and receives the upper and lower manual keying signals for the C and C# notes of the organ. Assume also that the C major chord C, E, G is being played in the first octave on the lower manual and the G note is being played in the second octave on the upper manual. The upper half of the ROM 314 corresponding to the C keying input signals will be unlocked via the NAND gate 368 and the NOR gate 372. Since there is no active upper manual keying signal on the conductors 204*a* and there is no upper manual active signal on the upper manual active input terminal 352 from the preceding chip (in this case there is no preceding chip), the octave above the octave of the active upper manual note is selected by the ROM 314 and the NOR gate 356 via the conductor 355 and the inverter 353 in response to the signal on the terminal 352.

The chip which receives the upper manual G keying signals generates 1 0 (second octave) octave identify signals on the conductors 318 and 320 respectively thereof since the G note is being played in the second octave on the upper manual. The 1 0 signals are passed to the octave identify bus comprising the conductors 212 to generate 1 0 octave identify signals on the conductors 340 and 342 respectively for all the chips in the harmony generating circuit 108. Since there is no upper manual keying signal active on the conductors 204*a* of the chip corresponding to the C note, the octave identify signals on the conductors 340 and 342 will be selected via the conductor 344, the inverter 354 and the AND gates 336 and 338.

The 1 on the conductor 340 generates a 0 on the third column 316*c* of the ROM 316 and a 1 on the fourth column 316*d* of the ROM 316. These signals disable the bottom three horizontal outputs of the upper (and lower) half of the ROM 316. The 0 on the condutor 342 generates a 1 on the fifth column 316*e* of the ROM 316 and a 0 on the sixth column 316*f* of the ROM 316. This disables the bottom most output and the top two outputs of the upper (and lower) half of the ROM 316. Accordingly, the top input of the NOR gate 390 which corresponds to the second octave C note and the lower input of the NOR gate 392 which corresponds to the third octave C note are enabled. It is noted that the identical selection is also performed in the lower half of the ROM 316. However, no harmony keying signals are generated on the conductors 210 since there are no active C# signals due to depressed C# keys on either the upper or lower manuals.

As previously described, the output of the NOR gate 356 selects the octave above the active upper manual note so that the output of the NOR gate 392 is activated to generate a C note one octave above the active upper manual G note, i.e., the G note is played in the second octave due to the depression of the second octave G key on the upper manual and the C note which corresponds to the C major chord being played on the accompaniment manual is played one octave about that active upper manual note or in the third octave through the upper manual. A similar selection of the E note in the third octave is performed on the chip 202 which generates harmony signals for the E and F notes and similarly appears on the upper half of its corresponding circuit chip.

Now referring to FIG. 3 as receiving the F#, G keying signals. The G keying signals are provided on the conductors 206*a* and 206*b* of the chip which generates the F#, G harmony keying signals for the organ. Since the G note is active on the upper manual, the second octave identify signals 1 0 are placed on the conductors 318 and 320 as previously described. These internal octave identity signals are selected via the ROM 312, the conductor 386, the gate 346, the conductor 344, the inverter 354 and the AND gates 326 and 328. In this case, the identical octave selection as described for the C note is performed in the ROM 316 since the octave identify signals are being provided by the G chip and are the same internally on the G chip and externally on the octave identify bus comprising the conductors 212.

Since an upper manual keying signal is active on the G inputs 206*a*, the lower half of the ROM 314 is forced to select the octave above the active upper manual note by the conductor 386 and the inverter 388. The octave select signal is generated by the ROM 314 and the NOR gate 362. Although the selection is via different circuitry which controls the first two columns 316*a* and 316*b* of the lower half of the ROM 316, the selection is the same as previously described for the C note. The G note one octave above the active upper manual note, G note, is generated by the NOR gate 394. Thus, the G note is played in the second octave through the upper manual due to the depression of the G key on the upper manual; the C major chord is played in the first octave through the lower manual due to the depression of the C, E, G keys on the lower manual. These notes are sounded via standard electronic organ circuitry. In addition, the C major chord being played on the lower manual is sounded through the upper manual one octave above the active note, G note, being played on the upper manual. In this example, the upper manual note was repeated one octave higher in pitch due to the chording signals from the lower manual. If the G key had not been depressed on the lower manual, the G note would still have been sounded one octave above the active G note on the upper manual. The operation of the circuitry for sounding of the upper manual G note one octave above the active upper manual note is substantially as described except the lower half of the ROM 314 is unlocked via the inverter 377 and the NOR gate 378 as previously described.

It is apparent from the above that a novel harmony signal generating circuit is disclosed. The harmony signal generating circuit provides harmony keying signals through the upper maual which correspond to chording signals being played on the lower manual but are one octave above an active upper manual note being keyed on the upper manual. Also the active upper manual note is repeated through the upper manual one octave higher in pitch than the active upper manual note. It should be understood that the invention is not to be limited to the specific embodiment described herein. Various alternate embodiments and modifications will be apparent to those skilled in the art. For example, various integrated circuit technology could be utilized to construct the harmony circuit other than MOS. Accordingly, NOR gates could be used to replace the ROM's of the preferred embodiment as described. These alternate embodiments and modifications are considered to be within the true spirt and scope of the present invention which is set out in the following claims.

What is claimed is:

1. A harmony generating system for use in an electronic organ having an upper manual for generating upper manual keying signals, a lower manual for generating lower manual keying signals and keyer circuits responsive to said upper and lower manual keying signals, said harmony generating system receiving upper manual keying signals and lower manual keying signals and having a plurality of integrated circuits with each circuit receiving said upper manual keying signals and said lower manual keying signals for at least one letter note and comprising:

octave identify means responsive to said upper manual keying signals for at least one letter note for generating an upper manual octave identify signal;

first circuit means responsive to said upper manual keying signals for at least one letter note for generating an upper manual active signal;

octave select means responsive to the absence or presence of said upper manual active signal from another one of said plurality of integrated circuits and said lower manual keying signals for at least one letter note for generating octave select signals; and second circuit means responsive to said upper manual octave identify signal, said upper manual active signal from said first circuit means of the same integrated circuit and to said octave select signals for generating harmony signals, said harmony signals corresponding to said lower manual keying signals for at least one letter note and said upper manual keying signals for at least one letter note and being within a twelve note range above the upper manual keying signals.

2. A harmony generating system for use in an electronic organ having an upper manual for generating upper manual keying signals, a lower manual for generating lower manual keying signals and keyer circuits responsive to said upper and lower manual keying signals, said harmony generating system comprising:

a plurality of integrated circuits connected together to form a series of integrated circuits with the first integrated circuit in said series chain receiving upper manual keying signals and lower manual keying signals for at least one letter note and each succeeding integrated circuit in said series chain receiving upper manual keying signals and lower manual keying signals for at least one letter note until all of the letter notes representing one octave are received in sequence by said circuits; each of said integrated circuits comprising:

octave identify means responsive to said upper manual keying signals for at least one letter note for generating an upper manual octave identify signal;

first circuit means responsive to said upper manual keying signals for at least one letter note for generating an upper manual active signal;

octave select means responsive to the absence or presence of said upper manual active signal from another one of said plurality of integrated circuits and said lower manual keying signals for at least one letter note for generating octave select signals; and second circuit means responsive to said upper manual octave identify signal, said upper manual active signal from said first circuit means of the same integrated circuit and to said octave select signals for generating harmony signals, said harmony signals corresponding to said lower manual keying signals for at least one letter note and said upper manual keying signals for at least one letter note and being within a twelve note range above the upper manual keying signals;

upper manual octave identify terminals, said octave identify terminals being connected in parallel among said plurality of integrated circuits and being connected to said second circuit means;

upper manual active terminals, said upper manual active terminals being connected in series among said plurality of integrated circuits;

first gating circuit means connected to one of said upper manual active terminals for passing an upper manual active signal to selected ones of said plurality of integrated circuits or to ground; and second gating circuit means responsive to the absence or presence of said upper manual active signal from another one of said plurality of integrated circuits and said octave identify signal and connected to one of said upper manual octave identify terminals for passing an octave identify signal to one of said octave identify terminals.

3. The harmony generating system of claim 2, wherein each of said second gating circuit means comprises selector circuitry responsive to said upper manual active signals for selectively connecting said octave identify means and said octave identify terminals to said second circuit means whereby active upper manual notes are repeated one octave higher in pitch.

4. The harmony generating system of claim 2 wherein said second circuit means of each of said plurality of integrated circuits comprises override circuitry responsive to upper manual active signals generated by the integrated circuit for controlling said second circuit means to generate harmony signals in the octave above active upper manual notes.

5. A harmony generating system for use in an electronic organ having an upper manual for generating upper manual keying signals, a lower manual for generating lower manual keying signals and keyer circuits responsive to said upper and lower manual keying signals, said harmony generating system receiving upper manual keying signals and lower manual keying signals and having a plurality of integrated circuits connected together to form a series of integrated circuits; said harmony generating system comprising:

a first integrated circuit receiving upper manual keying signals for at least one letter note indicative of the first note in a twelve note octave and lower manual keying signals for the same at least one letter note and comprising:

octave identity means responsive to said upper manual keying signal for at least one letter note for generating an upper manual octave identity signal;

first circuit means responsive to said upper manual keying signals for at least one letter note for generating an upper manual active signal;

octave select means responsive to said lower manual keying signals for at least one letter note for generating an octave select signal;

second circuit means responsive to said upper manual octave identity signal, said octave select signal and said upper manual active signal of said first circuit means of said first integrated circuit for generating harmony signals, said harmony signals corresponding to said lower manual keying signals for at least one letter note and said upper manual keying signals for at least one letter note and being within a twelve note range above said upper manual keying signals;

a plurality of intermediate integrated circuits each receiving upper manual keying signals for at least one letter note indicative of notes above said first note in a twelve note octave and lower manual keying signals for the same at least one letter note and each of said plurality of intermediate integrated circuits comprising:

octave identity means responsive to said upper manual keying signals for at least one letter note for generating an upper manual octave identity signal;

first circuit means responsive to said upper manual keying signals for at least one letter note for generating an upper manual active signal;

octave select means responsive to said upper manual active signal from another one of said plurality of intermediate integrated circuits or to said upper manual active signal from said first integrated circuit and said lower manual keying signals for at least one letter note for generating an octave select signal; and, second circuit means responsive to said upper manual octave identity signal, said octave select signal and said upper manual active signal of said first circuit means of said intermediate integrated circuit for generating harmony signals, said harmony signals corresponding to said lower manual keying signals for at least one letter note and said upper manual keying signals for at least one letter note and being within a twelve note range above said upper manual keying signals; and, a last integrated circuit receiving upper manual keying signals for at least one letter note indicative of the last note in a twelve note octave and lower manual keying signals for the same at least one letter note and comprising:

octave identifying means responsive to said upper manual keying signals for at least one letter note for generating an upper manual octave identity signal;

first circuit means responsive to said upper manual keying signals for at least one letter note for generating an upper manual active signal;

octave select means responsive to said upper manual active signal from one of said plurality of intermediate integrated circuits or said upper manual active signal from said first integrated circuit and said lower manual keying signals for at least one letter note for generating an octave select signal;

second circuit means responsive to said upper manual octave identity signal, said octave select signal and said upper manual active signal of said last integrated circuit means for generating harmony signals, said harmony signals corresponding to said lower manual signals for at least one letter note and said upper manual keying signals for at least one letter note and being within a twelve note range above said upper manual keying signals.

* * * * *